US011198585B2

(12) United States Patent
Samba Murthy

(10) Patent No.: US 11,198,585 B2
(45) Date of Patent: Dec. 14, 2021

(54) SYSTEMS AND METHODS FOR CONTROLLING WORKING FLUID IN HYDRAULIC ELEVATORS

(71) Applicant: TK Elevator Corporation, Alpharetta, GA (US)

(72) Inventor: Aravind Samba Murthy, Atlanta, GA (US)

(73) Assignee: TK Elevator Corporation, Atlanta, GA (US)

( * ) Notice: Subject to any disclaimer, the term of this patent is extended or adjusted under 35 U.S.C. 154(b) by 349 days.

(21) Appl. No.: 16/278,389

(22) Filed: Feb. 18, 2019

(65) Prior Publication Data

US 2020/0262677 A1 Aug. 20, 2020

(51) Int. Cl.

| | |
|---|---|
| ***F15B 11/10*** | (2006.01) |
| ***B66B 1/04*** | (2006.01) |
| ***B66B 1/30*** | (2006.01) |
| ***B66B 5/00*** | (2006.01) |
| ***B66B 9/04*** | (2006.01) |
| ***B66B 11/04*** | (2006.01) |

(52) U.S. Cl.

CPC ..... *B66B 1/04* (2013.01); *B66B 1/30* (2013.01); *B66B 5/0018* (2013.01); *B66B 9/04* (2013.01); *B66B 11/0423* (2013.01); *F15B 11/10* (2013.01); *F15B 2211/20515* (2013.01); *F15B 2211/20561* (2013.01); *F15B 2211/25* (2013.01); *F15B 2211/6309* (2013.01); *F15B 2211/6313* (2013.01); *F15B 2211/6651* (2013.01); *F15B 2211/6653* (2013.01)

(58) Field of Classification Search

CPC ..... B66B 1/04; B66B 9/04; B66B 11/0423; F15B 2211/20515; F15B 2211/20561

See application file for complete search history.

(56) References Cited

U.S. PATENT DOCUMENTS

| | | | | |
|---|---|---|---|---|
| 4,548,296 A | 10/1985 | Kisaku | | |
| 6,059,073 A * | 5/2000 | Gilliland | F16K 17/065 | 187/275 |
| 6,142,259 A * | 11/2000 | Veletovac | B66B 1/24 | 187/287 |
| 6,742,629 B2 * | 6/2004 | Veletovac | B66B 9/04 | 187/275 |
| 6,957,721 B2 * | 10/2005 | Moser | B66B 9/04 | 187/285 |
| 6,971,481 B2 * | 12/2005 | Moser | B66B 9/04 | 187/285 |

(Continued)

*Primary Examiner* — Thomas E Lazo

(74) *Attorney, Agent, or Firm* — William J. Cassin

(57) ABSTRACT

A hydraulic elevator may comprise a bidirectional pump that controls up and down motion of an elevator car. A VVVF drive may cause the bidirectional pump to provide working fluid in a controlled manner to a hydraulic jack that supports the elevator car. A control valve may be disposed between the bidirectional pump and the hydraulic jack so that the control valve can be closed when the elevator car needs to be held in place. To avoid pressure waves that propagate when the control valve is opened with disparate pressures on the pump and jack sides of the control valve, the bidirectional pump may adjust the pressure on the pump side of the closed control valve to the pressure on the jack side of the control valve before the control valve is opened.

8 Claims, 7 Drawing Sheets

(56) References Cited

U.S. PATENT DOCUMENTS

| | | | | |
|---|---|---|---|---|
| 7,134,528 | B2 * | 11/2006 | Birbaumer | B66B 1/24 187/285 |
| 9,457,986 | B2 | 10/2016 | Roland | |
| 9,897,112 | B2 * | 2/2018 | Gomm | F15B 15/08 |

* cited by examiner

SYSTEMS AND METHODS FOR CONTROLLING WORKING FLUID IN HYDRAULIC ELEVATORS

FIELD OF THE DISCLOSURE

The present disclosure generally relates to hydraulic elevators, including systems and methods for controlling working fluid used in hydraulic elevators.

BACKGROUND

Hydraulic elevators utilize hydraulic jacks for raising and lowering elevator cars between floors of a building. Put simply, to raise an elevator car, a motor-driven pump supplies pressurized working fluid to a hydraulic jack. To lower the elevator car, the working fluid in the hydraulic jack is vented back to a tank. When moving an elevator car between floors, the rate and amount of working fluid supplied to the hydraulic jack must be accurately controlled so as to provide a smooth ride and stop the elevator car at the desired floor. Such hydraulic elevators typically use a fixed-speed alternating current (AC) motor and a fixed-displacement pump. Therefore, in most hydraulic elevators, the rate and amount of working fluid supplied to the hydraulic jack is controlled by way of a control valve. When the elevator car is instructed to move upward, such as when a passenger activates a button inside the elevator car or a button on a floor of a building, the pump begins to supply working fluid to the control valve. The control valve in turn supplies pressurized working fluid to the hydraulic jack. Conversely, when the elevator car is instructed to move downward, the control valve vents working fluid from the hydraulic jack back to the tank, bypassing the pump.

In both the up and down directions, the control valve is used to control the speed and position of the elevator car. When the elevator car travels upward, the control valve can regulate the amount of pressurized working fluid that is supplied from the pump to the hydraulic jack by venting some or all of the working fluid from the pump back to the tank. In this manner, the control valve controls the elevator car's upward speed and stops the elevator car when the elevator car reaches the desired floor. When the elevator car travels downward, the pump does not operate and the control valve can regulate the rate at which working fluid is vented from the hydraulic jack to the tank, thereby controlling the elevator car's downward speed and position.

Conventional hydraulic elevators such as these are operated using a fixed-speed pump that is driven using a prime mover such as an electric motor running at synchronous speed. As explained above, speed control is achieved by using the control valve to control the flow rate of the working fluid in the hydraulic jack. One problem with such hydraulic elevators, however, is that the working fluid that bypasses the pump and is vented by the control valve to the tank is heated unnecessarily and undesirably. Heating the working fluid is inefficient, as energy that could be put to mechanical work is wasted on heating the working fluid. Moreover, heating the working fluid leads to unpleasant odors that can be smelled on the floors of the building and/or in the elevator car. Heating can also affect the viscosity of the working fluid, which can adversely impact the operating characteristics of the hydraulic elevator.

Other approaches to controlling hydraulic elevators involve influencing the flow rate of working fluid to the hydraulic jack by way of pump commands rather than by way of valve commands. Advances in variable-voltage variable-frequency (VVVF) AC motor controls have made low-cost, variable speed AC motors a viable option. Such AC motors are typically used with bidirectional hydraulic pumps to control the rate of working fluid flow in the hydraulic jack and thereby the speed of the elevator car. The control valve may remain open while the elevator car is moving, and the movement and the position of the elevator car may be controlled using only the pump. Because the control valve is disposed between the hydraulic jack and the pump, the control valve can be closed when the elevator car needs to be held in place. One problem with such an arrangement occurs when the control valve is opened when there is a significant pressure difference between an inlet (i.e., pump-side) of the control valve and an outlet (i.e., jack-side) of the control valve. Upon opening the control valve, a resultant pressure wave causes undesirable vibrations in the elevator car and can significantly degrade ride quality.

DETAILED DESCRIPTION

Although certain example methods and systems are described herein, the scope of coverage of this patent is not limited thereto. On the contrary, this patent covers all methods, systems, and articles of manufacture fairly falling within the scope of the appended claims either literally or under the doctrine of equivalents. Moreover, those having ordinary skill in the art will understand that reciting "a" element or "an" element in the appended claims does not restrict those claims to articles, apparatuses, systems, methods, or the like having only one of that element, even where other elements in the same claim or different claims are preceded by "at least one" or similar language. Similarly, it should be understood that the steps of any method claims need not necessarily be performed in the order in which they are recited, unless so required by the context of the claims. In addition, all references to one skilled in the art shall be understood to refer to one having ordinary skill in the art.

Figure 1:
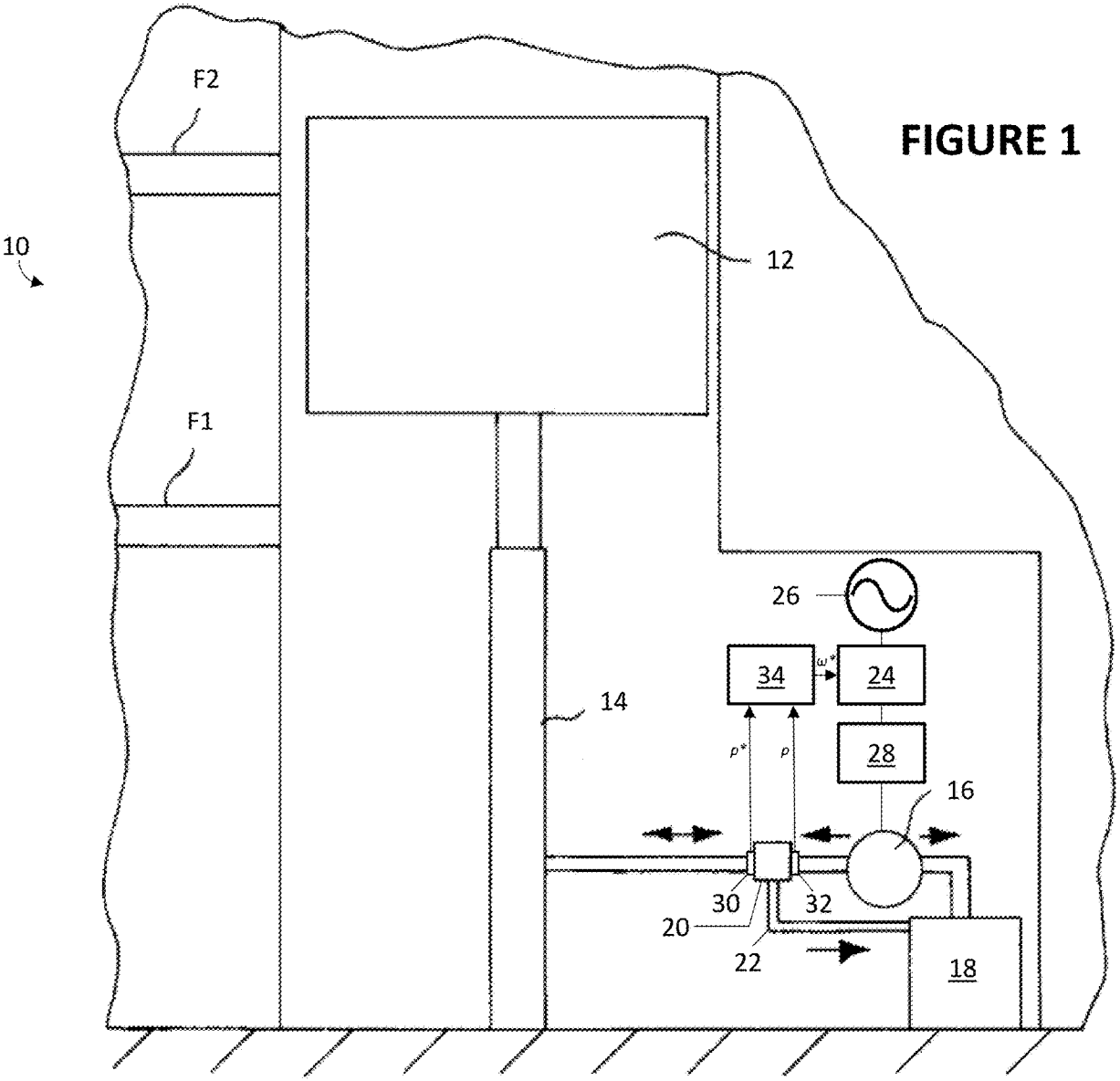
FIG. 1 is a schematic view of an example hydraulic elevator.

Referring now to FIG. 1, an example hydraulic elevator 10 may include an elevator car 12 that is supported by a hydraulic jack 14. A bidirectional pump 16 may drive working fluid between a tank 18 and the hydraulic jack 14 to move the elevator car 12 between two or more floors F1, F2 of a building. In other words, the bidirectional pump 16 may control the movement of the elevator car 12 by controlling at least the flow rate of the working fluid in the hydraulic jack 14. In some examples, a control valve 20 may be disposed between the tank 18 and the hydraulic jack 14. To permit the bidirectional pump 16 to control the movement of the elevator car 12 via the hydraulic jack 14, the control valve 20 may remain open while the elevator car 12 is moving. Thus, under normal operating conditions, the control valve 20 remains fully open and movement of the elevator car 12 is controlled using only the bidirectional pump 16. That said, the control valve 20 may be closed for purposes of maintaining a position of the elevator car 12.

Alternatively, it may be possible for the bidirectional pump 16 to maintain the position of the elevator car 12 without closing the control valve 20, though such practice is typically less energy efficient than closing the control valve 20. Moreover, while it is generally true that the control valve 20 remains fully open when the elevator car 12 is moving, it should be understood that in some cases the control valve 20 may be in the act of transitioning open (or transitioning closed) when the elevator car 12 is just beginning (or just ending) a "run" between the two or more floors F1, F2.

In some examples, the hydraulic elevator 10 may include a return line 22 leading from the control valve 20 to the tank 18 of working fluid. The return line 22 may not be used under normal operating conditions, but may be advantageous as a form of redundancy in some scenarios. For instance, if for some reason the bidirectional pump 16 were to become unusable to lower the elevator car 12, the control valve 20 could vent working fluid at a controlled rate from the hydraulic jack 14 back to the tank 18 so as to cause working fluid to bypass the bidirectional pump 16 and thereby lower the elevator car 12 at a controlled rate.

As also shown in FIG. 1, a VVVF drive 24 may feed electrical energy from an AC power source 26 to an AC motor 28 that generates the force used to power the bidirectional pump 16. An outlet sensor 30 may be disposed at a hydraulic jack-side of the control valve 20, and an inlet sensor 32 may be disposed at a pump-side of the control valve 20. The sensors 30, 32 may be configured to measure pressure of the working fluid on both sides of the control valve 20. A pump-side pressure p measured at the inlet sensor 32 generally corresponds to a pressure in the bidirectional pump 16, whereas a jack-side pressure p* measured at the outlet sensor 30 generally corresponds to a pressure in the hydraulic jack 14.

It should be understood that various subsets of components of the example hydraulic elevators disclosed herein may be referred to by other names, such as a "system for controlling working fluid in a hydraulic elevator," for example and without limitation. Likewise, those having ordinary skill in the art should understand that references to a "first" component or a "second" component may change depending on the example, the claim, etc. For instance, in one group of claims the pump-side pressure p may be referred to as a "first" pressure, whereas in a different group of claims the pump-side pressure p may be referred to as a "second" pressure.

Figure 2:
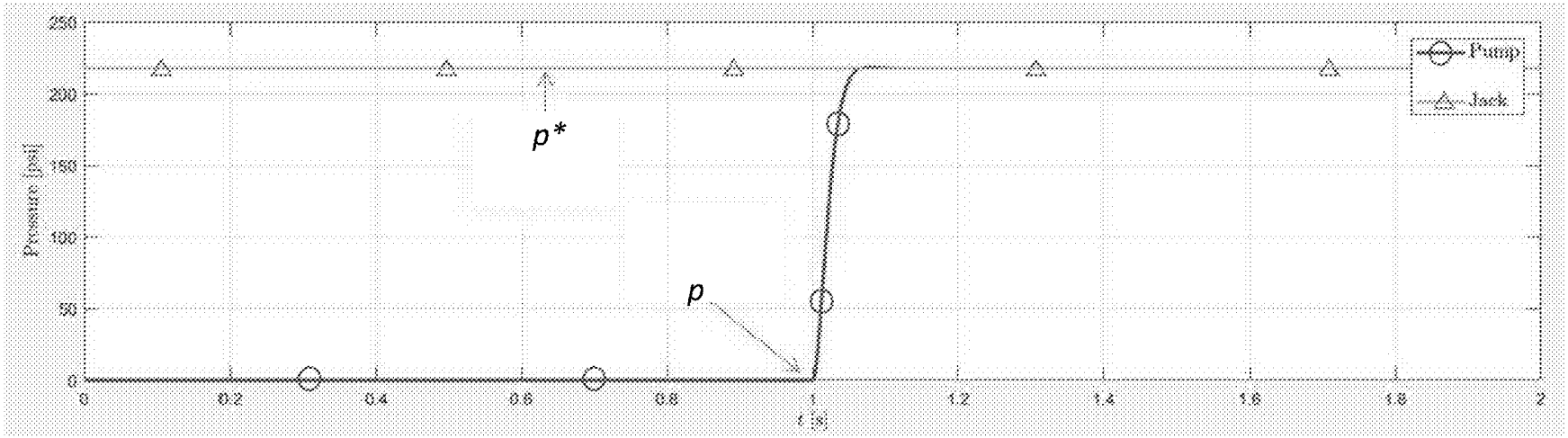
FIG. 2 is a chart illustrating a response time required for an example bidirectional pump to adjust a pressure in the bidirectional pump to a pressure of a hydraulic jack that supports an elevator car.

To prevent the formation and propagation of pressure waves as described above, when the control valve 20 is closed, the hydraulic elevator 10 may cause the bidirectional pump 16 to adjust the pump-side pressure p to and/or maintain the pump-side pressure p at the jack-side pressure p*. The bidirectional pump 16 may adjust and/or maintain the pump-side pressure p to be substantially equal to the jack-side pressure p*, such as within 0.5%, 1.0%, 1.5%, 2.0%, 2.5%, 3.0%, 4.0%, 5.0%, 7.5%, 10.0%, 12.5%, 15.0%, 20.0%, or 25.0% of the jack-side pressure p*. In some cases, the bidirectional pump 16 may adjust and/or maintain the pump-side pressure p to the jack-side pressure p* as long as the elevator car 12 is stopped and the control valve 20 is closed. In other cases, though, the bidirectional pump 16 may only adjust and/or maintain the pump-side pressure p to the jack-side pressure p* at a time just prior to when the control valve 20 opens and the elevator car 12 begins a new "run" between the floors F1 and F2. In other words, because the bidirectional pump 16 can adjust and/or maintain the pump-side pressure p to the jack-side pressure p* in a split second (e.g., less than 100 ms), as shown for example in FIG. 2, the bidirectional pump 16 may only begin to adjust the pump-side pressure p after the elevator car 12 has been called or, alternatively, just 0.05, 0.10, 0.25, 0.50, 0.75, 1.00, 1.50, 2.00, or 2.50 seconds, for example and without limitation, before the control valve 20 is opened.

In still other cases, the bidirectional pump 16 may intermittently adjust the pump-side pressure p based on the jack-side pressure p* so that the bidirectional pump 16 only has to make a minor adjustment to the pump-side pressure p a split second before opening the control valve 20. Operating the bidirectional pump 16 in this manner may be desirable to account for pump leakage effects, for instance. Nonetheless, those having ordinary skill in the art will appreciate that operating the bidirectional pump 16 in these manners consumes less energy than maintaining the pump-side pressure p to the jack-side pressure p* all the while the elevator car 12 is stopped.

One purely exemplary way in which the hydraulic elevator 10 can cause the bidirectional pump 16 to operate in this manner is to employ a controller 34. The controller 34 may configure the VVVF drive 24 to power the AC motor 28 in a way such that the bidirectional pump 16 adjusts/maintains the pump-side pressure p measured at the inlet sensor 32 at the pump-side of the control valve 20 to the jack-side pressure p* measured at the outlet sensor 30 at the jack-side of the control valve 20. The jack-side pressure p* will likely change after each "run" of the elevator car 12 based on factors such as, for example, weight in the elevator car 12.

Figure 3:
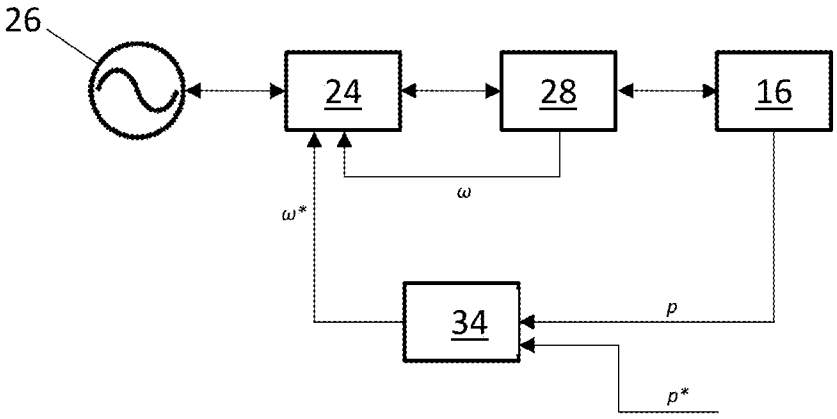
FIG. 3 is a block diagram of an example control system architecture that can be employed by the example hydraulic elevator of FIG. 1 in connection with a VVVF drive operating in a speed-control mode.

In some examples such as that represented in the block diagram of FIG. 3, the VVVF drive 24 may operate in a speed-control mode when adjusting/maintaining the pump-side pressure p to the jack-side pressure p*. When the VVVF drive 24 operates in speed-control mode, the AC motor 28 may provide a motor speed signal co as feedback to the VVVF drive 24. The motor speed signal co may be measured by the AC motor 28 and/or by a sensor disposed within the AC motor 28, for instance. Amongst other data, the controller 34 may receive the pressures p and p* measured by the sensors 30, 32. Based on at least these pressures p and p*, the controller 34 may provide the VVVF drive 24 with a speed reference signal ω* that informs the VVVF drive 24 as to how to control the speed of the AC motor 28, particularly in light of the motor speed signal ω that the AC motor 28 provides to the VVVF drive 24. Finally, due at least in part to the controller 34 and the speed reference signal ω* that the controller 34 provides to the VVVF drive 24, the hydraulic elevator 10 may be said to be operating under closed-loop pressure control with respect to the working fluid. Upon opening the control valve 20, with respect to the working fluid, the hydraulic elevator 10 may then seamlessly transfer back to closed-loop velocity control or closed-loop flow control.

As those having ordinary skill in the art will understand, the controller 34 may be disposed in a variety of locations.

Likewise, those having ordinary skill in the art will understand that the controller 34 may be embodied in a wide variety of shapes and sizes. In some examples, the controller 34 may include one or more of a motherboard, a processor, non-transitory computer-readable media, and/or a hard disk. In other examples, however, the controller may be embodied as non-transitory computer-readable media. Non-transitory computer-readable media may comprise, for example, one or more of the following: electronic, magnetic, optical, electromagnetic, or semiconductor media; a portable magnetic computer diskette such as floppy diskettes or hard drives; programmable read-only memory (ROM); non-programmable ROM; random access memory (RAM) such as dynamic random-access memory (DRAM), static random-access memory (SRAM), or extended data output random-access memory (EDO RAM); a portable compact disc; hardware memory; non-transitory tangible media such as magnetic storage disks, optical disks, or flash drives; programmable processing devices; application-specific integrated circuits (ASICs); programmable arrays; digital signal processing circuitry; electrically erasable programmable read-only memory (EEPROM); compact disc read-only memory (CD-ROM); digital versatile discs (DVDs); blu-ray discs; or dual in-line memory modules (DIMMs). Further, any executable code residing in the non-transitory computer-readable media may comprise any set of instructions to be executed directly (such as machine code) or indirectly (such as scripts) by a processor. In this respect, the terms "instructions," "scripts," and "applications" may be used interchangeably herein. It should also be understood that executable code may be stored in any computer language or format, such as in object code or modules of source code, for instance. Finally, executable code may be implemented in the form of hardware, software, or a combination thereof.

In some examples where the controller 34 regulates the pump-side pressure p to the jack-side pressure p* using a speed reference command of the VVVF drive 24, the controller 34 may be a peripheral interface controller (PIC) that can be characterized by a physics-based model. For instance, motor speed dynamics may be described according to $$J\dot{\omega}=T_e-k_\theta\omega-dp, \tag{1}$$

where J is motor inertia (kg·m$^2$), $k_\theta$ is friction (Nm·s), $T_e$ is motor torque, ω is motor speed (rad/s), d is pump displacement (m$^3$), and p is the pump-side pressure (Pα) (i.e., the pressure measured at the inlet sensor 32 at the pump side of the control valve 20 as described above). Pump flow rate a (m$^3$/s) is directly proportional to the motor speed ω in that $$q=d\omega. \tag{2}$$

When the control valve 20 is closed, all of the pump flow rate q is attributable to leakage or slip of the bidirectional pump 16 such that $$q = q_{slip} = \frac{p}{r}, \tag{3}$$

where r is pump slip resistance (Pa·s/m$^3$) associated with the bidirectional pump 16. Typically manufacturers of pumps make the pump slip resistance r available by way of datasheets or the like.

Further, when the VVVF drive 24 is operating in speed-control mode, the VVVF drive 24 may be characterized by $$T_e=-\gamma(\omega-\omega^*), \tag{4}$$

where ω* is a motor speed reference and γ is a proportional gain (Nm/rad/s) of the controller 34. A state-space representation of the overall system with the pump-side pressure p as a state variable and the motor speed reference ω* as a control variable is obtained by substituting equations (2), (3), and (4) into equation (1), resulting in $$\dot{p} + a_s p = b_s\omega^*, \text{ where} \tag{5}$$

$$a_s = \frac{\gamma + k_\theta + rd^2}{J}, \text{ and} \tag{6}$$

$$b_s = \frac{\gamma rd}{J}. \tag{7}$$

With respect to state space, the controller 34 that regulates the pump-side pressure p to match the jack-side pressure p* may be characterized by $$\omega^*=-K_1p-K_2\sigma, \tag{8}$$

$$\dot{\sigma}^*p-p^* \tag{9}$$

where σ is an integral of a pressure difference between the pump-side pressure p and the jack-side pressure p*, $K_1$ is proportional gain of the controller 34, and $K_2$ is integral gain of the controller 34.

Figure 4:
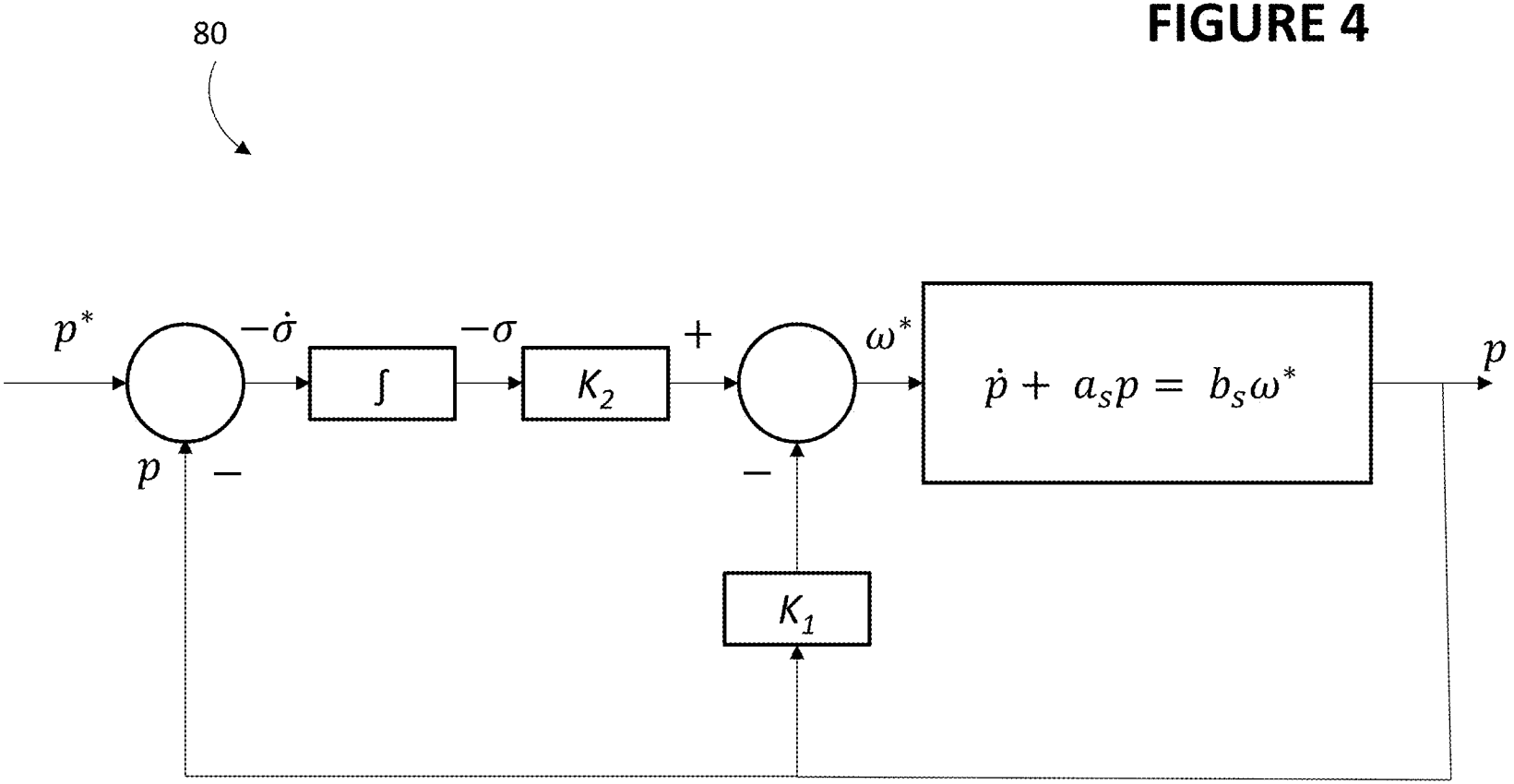
FIG. 4 is a block diagram representation of a state-space integral controller for regulating pump pressure with a VVVF drive in speed-control mode.

A block diagram representation 80 of the example control logic of controller 34 with the VVVF drive 24 in speed-control mode is shown in FIG. 4. The closed-loop control system dynamics of the controller 34, the bidirectional pump 16, and the VVVF drive 24 can be characterized in state-space form by combining equations (5), (8), and (9) according to $$\begin{bmatrix} \dot{p} \\ \dot{\sigma} \end{bmatrix} = \begin{bmatrix} -(a_s + b_sK_1) & -b_sK_2 \\ 1 & 0 \end{bmatrix} \begin{bmatrix} p \\ \sigma \end{bmatrix} + \begin{bmatrix} 0 \\ -1 \end{bmatrix} p^*. \tag{10}$$

The controller gains $K_1$ and $K_2$ may be chosen such that the overall system is characterized by a desired control system bandwidth $\lambda_s$. Those having ordinary skill in the art will appreciate that a large value of the desired control system bandwidth $\lambda_s$ would lead to a fast-acting controller, but it may also increase the magnitudes of the controller gains $K_1$ and $K_2$, which could cause problems related to actuator saturation. Thus, selection of the desired control system bandwidth $\lambda_s$ involves a trade-off between rate of response and control effort. Using equation (10), the controller gains $K_1$ and $K_2$ may be obtained as $$K_1 = \frac{2\lambda_s - a_s}{b_s} \tag{11}$$

and $$K_2 = \frac{\lambda_s^2}{b_s}. \tag{12}$$

Figure 5:
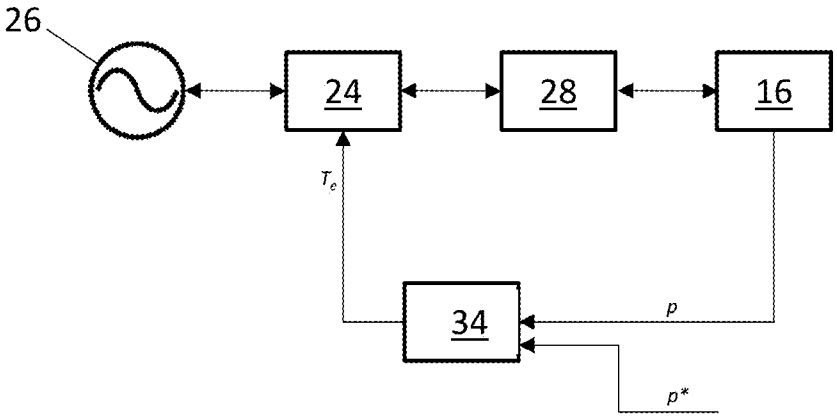
FIG. 5 is a block diagram of an example control system architecture that can be employed by the example hydraulic elevator of FIG. 1 in connection with a VVVF drive operating in a torque-control mode.

As shown in FIG. 5, the VVVF drive 24 may also operate in a torque-control mode, whereby the controller 34 can provide the motor torque $T_e$ signal that informs the VVVF drive 24 as to how to control the AC motor 28. When the VVVF drive 24 operates in torque-control mode, the VVVF drive 24 can dictate a desired electromechanical torque at an output shaft of the AC motor 28. A state-space representation of the controller 34, the bidirectional pump 16, and the VVVF drive 24 in torque-control mode with the pump-side pressure p as a state variable and the motor torque $T_e$ as the control variable may be obtained by substituting equations (2) and (3) into equation (1), resulting in $$\dot{p} + a_t p = b_t T_e, \text{ where} \tag{13}$$

$$a_t = \frac{k_\theta + rd^2}{J}, \text{ and} \tag{14}$$

$$b_t = \frac{rd}{J}. \tag{15}$$

The controller 34 that regulates the pump-side pressure p to match the jack-side pressure p* is defined according to $$T_e = -K_e p - K_4 \sigma, \tag{16}$$

and $$\dot{\sigma} = p - p^*, \tag{17}$$

where σ is the integral of pressure difference between the pump-side pressure p and the jack-side pressure p*, $K_3$ is proportional gain of the controller 34, and $K_4$ is integral gain of the controller 34.

Figure 6:
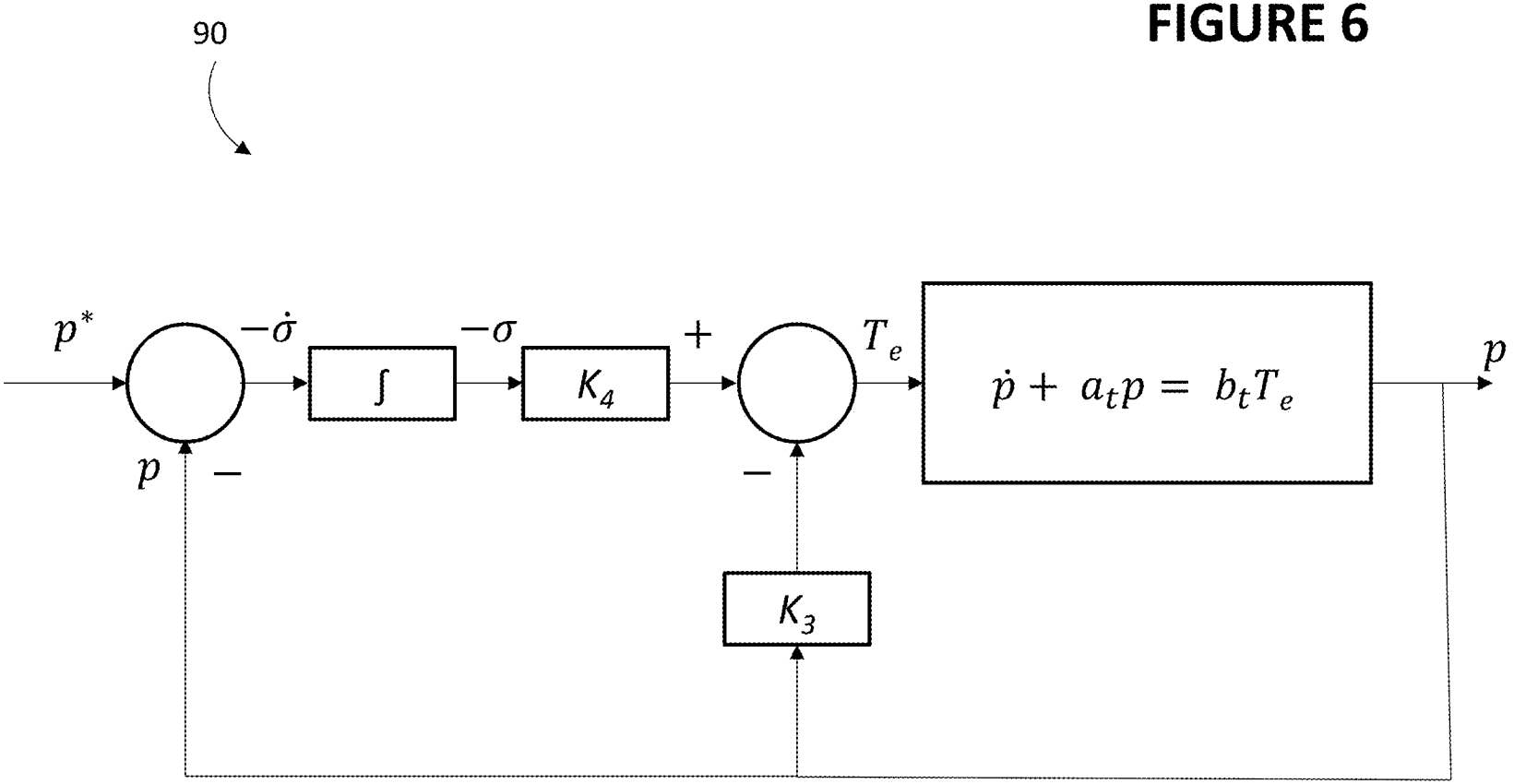
FIG. 6 is a block diagram representation of an example state-space integral controller for regulating pump pressure with a VVVF drive in torque-control mode.

A block diagram representation 90 of example control logic of the controller 34 with the VVVF drive 24 operating in torque-control mode is shown in FIG. 6. The closed-loop control system dynamics of the controller 34, the bidirectional pump 16, and the VVVF drive 24 can be characterized in state-space form by combining equations (13), (16), and (17) according to $$\begin{bmatrix} \dot{p} \\ \dot{\sigma} \end{bmatrix} = \begin{bmatrix} -(a_t + b_t K_3) & -b_t K_4 \\ 1 & 0 \end{bmatrix} \begin{bmatrix} p \\ \sigma \end{bmatrix} + \begin{bmatrix} 0 \\ -1 \end{bmatrix} p^*. \tag{18}$$

The controller gains $K_3$ and $K_4$ may be chosen such that the closed-loop control system dynamics of the controller 34, the bidirectional pump 16, and the VVVF drive 24 are characterized by a desired control system bandwidth $\lambda_t$. As explained above, a large value for the desired control system bandwidth $\lambda_t$ may lead to a fast-acting controller, but it may also increase the magnitudes of the controller gains $K_3$ and $K_4$, which may cause problems related to actuator saturation. Therefore, as noted above, the selection of the desired control system bandwidth $\lambda_t$ involves a trade-off between rate of response and control effort. The controller gains $K_3$ and $K_4$ are obtained as $$K_3 = \frac{2\lambda_t - a_t}{b_t} \tag{19}$$

and $$K_4 = \frac{\lambda_t^2}{b_t}. \tag{20}$$

Figure 7:
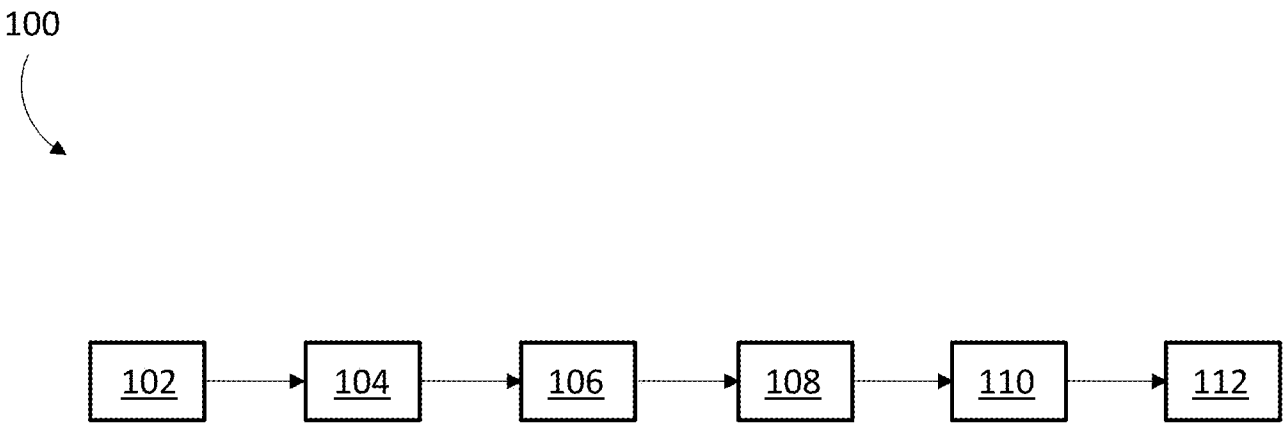
FIG. 7 is a flow diagram representing an example method of controlling working fluid in a hydraulic elevator.

Without reiterating the aforementioned aspects of the present disclosure in detail, those having ordinary skill in the art will appreciate that the present disclosure applies equally to methods of operating hydraulic elevators. As shown in FIG. 7, for instance, one exemplary method 100 may comprise measuring 102 a pressure on a first side of a closed control valve. The pressure on the first side of the control valve may be equal to, or at least representative of, a pressure in a hydraulic jack that is in fluid communication with the first side of the control valve. The method 100 may also comprise measuring 104 a pressure on a second side of the closed control valve. The pressure on the second side of the control valve may be equal to, or at least representative of, a pressure in a bidirectional pump that is in fluid communication with the second side of the control valve. It should be understood that the steps of measuring pressures 102, 104 may occur in any order or simultaneously. The method 100 may further comprise comparing 106 the pressure measured on the first side of the closed control valve to the pressure measured on the second side of the closed control valve. In some example methods such as the example method 100 depicted in FIG. 7, the method 100 may involve measuring 108 a speed of a motor that is coupled to the bidirectional pump and providing the measured speed to a drive that provides power in a controlled manner to the motor.

Notwithstanding, based on the comparison of the pressures on the first and second sides of the closed control valve, the method 100 may involve commanding 110 the drive to power the motor coupled to the bidirectional pump such that the bidirectional pump adjusts/maintains the pressure on the second side of the closed control valve to the pressure on the first side of the closed control valve. Although not shown in FIG. 7, the drive may use the measured speed of the motor as a reference when powering the motor. Once the pressures on both sides of the closed control valve are equal, the method 100 may involve opening the control valve 112, which thereby causes the bidirectional pump to have control over the position, velocity, and/or acceleration of an elevator car supported by the hydraulic jack. In some example methods, with respect to working fluid used throughout a hydraulic system of the hydraulic elevator, once the control valve is opened the hydraulic elevator may seamlessly switch from closed-loop pressure control (of the working fluid) to closed-loop flow control (of the working fluid) or closed-loop velocity control (of the working fluid).

What is claimed is:

1. A system for controlling working fluid in a hydraulic elevator, the system comprising:

a hydraulic jack;

a control valve in fluid communication with the hydraulic jack, wherein the control valve is configurable in an open position and in a closed position;

a pump in fluid communication with the control valve, wherein the control valve is disposed between the pump and the hydraulic jack;

a motor configured to generate a force for powering the pump;

a controller, wherein when the control valve is in the closed position the controller causes the pump to at least one of adjust a first pressure on a pump side of the control valve to a second pressure on a hydraulic jack side of the control valve or maintain the first pressure at the second pressure; and a VVVF drive configured to provide electricity from a power source to the motor, and to operate in a speed-control mode when the controller causes the pump to adjust the first pressure to be within 1.0% of the second pressure, wherein a motor speed signal from the motor is provided as feedback to the VVVF drive.

2. The system of claim 1 wherein the controller causes the pump to maintain or adjust the first pressure on the pump side of the control valve to be within 2.5% of the second pressure on the hydraulic jack side of the control valve when the control valve is in the closed position.

3. The system of claim 1 wherein the pump is a bidirectional pump.

4. The system of claim 3 wherein as the hydraulic jack moves an elevator car up and down, the control valve remains open and the bidirectional pump controls the hydraulic jack and movement of the elevator car.

5. The system of claim 1, wherein the VVVF drive transitions from the speed-control mode to closed-loop velocity control or closed-loop flow control when the control valve moves from the closed position into the open position.

6. The system of claim 1, wherein based on the first and second pressures, the controller provides the VVVF drive with a speed reference signal that informs the VVVF drive as to how to control a speed of the motor.

7. The system of claim 1, further comprising:

a first pressure sensor disposed on the pump side of the control valve, wherein the first pressure sensor measures the first pressure, which is transmitted to the controller; and a second pressure sensor disposed on the hydraulic jack side of the control valve, wherein the second pressure sensor measures the second pressure, which is transmitted to the controller.

8. The system of claim 1 wherein the controller causes the pump to adjust the first pressure within 1.0% of the second pressure less than a second prior to a time at which the control valve begins to transition from the closed position to the open position.

* * * * *